United States Patent [19]

Debaes

[11] Patent Number: 4,875,507

[45] Date of Patent: Oct. 24, 1989

[54] PROCESS AND APPARATUS FOR GUIDING THE WEFT THREADS IN WEAVING LOOMS

[75] Inventor: Johny Debaes, Wevelgem, Belgium

[73] Assignee: N.V. Michel Van De Wiele, Kortrijk-Marke, Belgium

[21] Appl. No.: 129,164

[22] Filed: Dec. 7, 1987

[30] Foreign Application Priority Data

Dec. 30, 1986 [BE] Belgium ..... 906,126

[51] Int. Cl.[4] ..... D03D 47/34

[52] U.S. Cl. ..... 139/450

[58] Field of Search ..... 139/429, 443, 444, 445, 139/446, 450, 453

[56] References Cited

U.S. PATENT DOCUMENTS

| | | | |
|---|---|---|---|
| 3,157,208 | 11/1964 | Juillard . | |
| 3,335,761 | 8/1967 | Bartosek et al. | 139/450 |
| 3,587,662 | 6/1971 | Remond | 139/450 |
| 3,916,956 | 11/1975 | Harris et al. | 139/446 |
| 4,384,598 | 5/1983 | Haussler | 139/446 |
| 4,540,028 | 9/1985 | Gehring et al. | 139/450 |

*Primary Examiner*—Henry S. Jaudon

*Attorney, Agent, or Firm*—James Creighton Wray

[57] ABSTRACT

A process and apparatus for guiding the weft threads in looms comprising a weft guiding element which moves over three consecutive positions which coincide with the various phases of the weft insertion during weaving. In the carry position, the weft guiding element is positioned so that the weft thread crosses the path of the insertion rapiers and the cut-off end of the weft thread is firmly clamped by the clamping device of the weft scissors. Immediately after the weft thread is carried by the insertion rapiers into the shed, the weft guiding element moves downward towards the lay and forward towards the weft cutting device into the insertion position. The weft thread is now situated in the shed. As the beat-up movement of the reed begins, the weft guiding element moves simultaneously upward with the lay and forward towards the weft scissors, the beat-up position. The weft thread is now held in a virtually straight line, virtually parallel to the reed. Also, the weft thread moves into the weft scissors which cut this weft thread free and the clamping device of the weft scissors holds the end of the following weft thread at the moment the reed is at its beat-up position. During the return movement of the lay, the weft guiding element moves simultaneously downward with the lay and moves forward towards the weft cutting device so that the carry position is achieved again. Thereafter, this process can begin anew.

11 Claims, 3 Drawing Sheets

PROCESS AND APPARATUS FOR GUIDING THE WEFT THREADS IN WEAVING LOOMS

Figure 1:
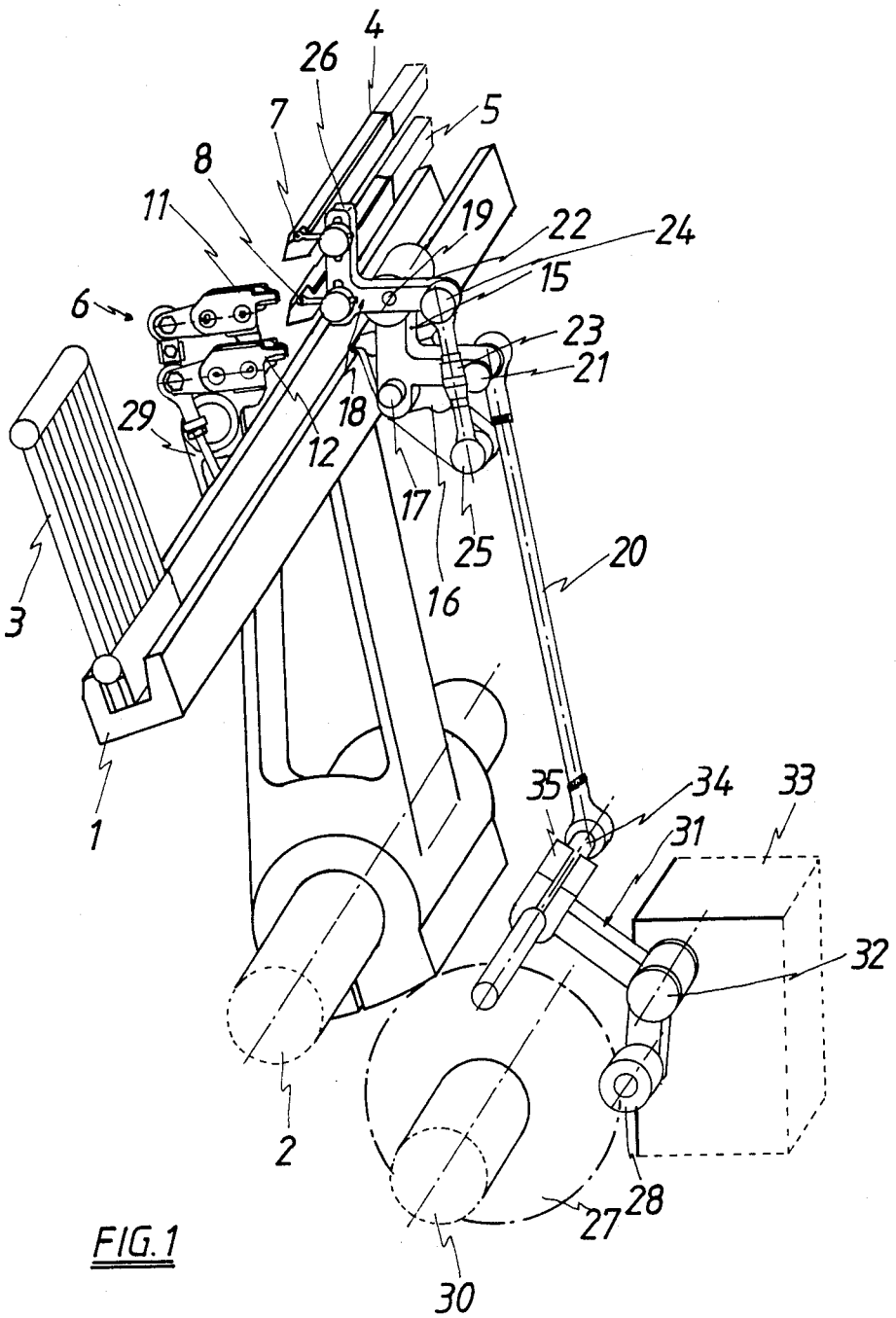

The present invention relates to a process for guiding the weft threads in weaving before, during and after their insertion into the fabric. The present invention also relates to an apparatus which carries out the process according to the invention. At the same time, the invention relates to weaving looms to which the process according to the invention is applied, and to weaving looms provided with an apparatus according to the invention.

The manipulations which a weft thread undergoes during weaving are the following: after cutting off the previous weft thread, the cut-off end of the following weft thread is firmly held at two points in a manner such that the means which pull the weft thread through the shed can take that end with them. These two points are generally the clamping mechanism of the weft-cutting device on one hand and a weft guiding element on the other hand. This weft thread is then pulled through the shed by the weft insertion means. The new weft thread is pushed against the fabric by the reed after the weft thread has been pulled completely through the shed, whereupon the weft-cutting device cuts this weft thread free and holds the end of the following weft thread.

The process and the apparatus according to the invention are particularly applicable to gripper weaving looms.

The means for the insertion of the weft threads in such weaving looms consist of a pair of rapiers, one of which is placed on either side of the reed. The first rapier, the insertion rapier, takes the weft thread to approximately half way along the width of the fabric, where the second rapier, the receiving rapier, takes over the weft thread and pulls it completely through the shed. The weft-cutting device can, moreover, be fastened securely onto the frame or, movably, onto the lay.

The weft guiding element in known weaving machines generally consists of a weft feed pin which is fixed on the frame or on the lay and therefore moving with the reed. This arrangement of the weft guiding element gives rise, however, to a number of problems during the various phases of the weft thread manipulation.

A very common problem is that the weft thread rubs against the warp threads as it is pulled through the shed. Due to this friction, and in the case of slubby yarn due to jamming, the weft thread can break or weft loss can occur. Some warp threads, especially the outermost warp threads, can also break through wear. The warp threads of synthetic yarns, such as polyester yarns, can melt because of heat generation which occurs as a result of the friction.

Another consequence of this arrangement of the weft guiding element is that the weft thread is pulled at sharp angles in some positions of the reed due to non-alignment of all the elements which act upon the weft thread, whilst this same weft thread makes no angles at all in other positions of the reed. Extra provisions, such as a weft-recovery device should be provided to prevent the weft thread from hanging loosely, or to retain the tension on the weft thread.

The goal of the present invention is to offer a solution to the problems mentioned so that the efficiency and the productivity of weaving looms is increased.

The process according to the invention for guiding weft threads in weaving looms is characterized by the movement of the weft thread in relation to the lay of the weaving loom over three consecutive positions at the height of the weft-cutting device at the position where the weft insertion means leave with a new weft thread: a first position, the carry position, in which the end of the weft thread originating from the bobbin is fed to the weft insertion means as the latter leaves for the insertion of a new weft; followed by a second position, the insertion position, in which the weft thread is situated in the triangle bordered by lower-upper-lying warp threads and the front surface of the reeds whilst it is pulled through the shed; followed by a third position, the beat-up position, in which the weft thread is held in a virtually straight line virtually parallel to the red, and is handed to the weft-cutting device at the moment that the reed is in its beat-up position; after which the complete sequence of positions begins anew.

The apparatus according to the invention for guiding weft threads in weaving looms is characterized in that a weft guiding element, which is movable in relation to the weaving lay, at the height of the weft-cutting device and at the position where the weft insertion means leave with a new weft thread, is provided, which moves by means of a drive over three consecutive positions: a first position, the carry position, in which the end of the weft thread originating from the bobbin is handed to the weft insertion means, as the latter leave to insert a new weft; followed by a second position, the insertion position, in which the weft thread is situated in the triangle bordered by lower- and upper-lying warp threads and the front surface of the reed whilst it is pulled through the shed; followed by a third position, the beat-up position, in which the weft thread is held in a virtually straight line, virtually parallel to the reed and is handed to the weft-cutting device at the moment that the reed is at its beat-up position; after which the complete sequence of positions begins anew.

The weft guiding element is fixed so that it can move on the lay of the weaving loom in a particular embodiment of the apparatus according to the invention and is driven via a rod mechanism from a cam with a cam follower.

Further details and advantages of the invention will be evident from the following description of a face to face weaving loom with rapiers in which the weft-cutting device is fixed on the lay so that it can tilt and is provided with a preferred embodiment of the apparatus according to the invention. This embodiment is described merely by way of example and has absolutely no limiting character. This description refers to the appended figures in which:

FIG. 1 is a diagrammatic perspective view of a section of a face to face weaving loom with rapiers and a weft-cutting device which is mounted to the lay so that it can tilt.

Figure 2A:
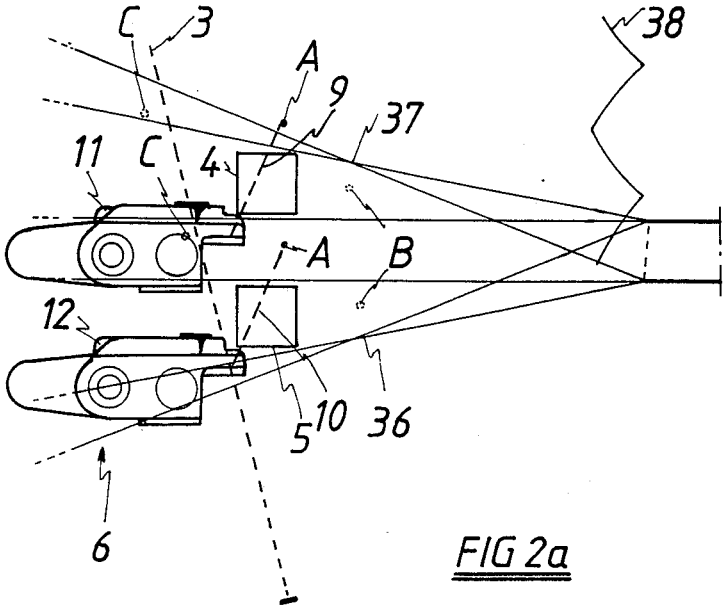

FIG. 2*a, b* and *c* are diagrammatic side-views of, respectively, the carry position, the insertion position and the beat-up position of the weft guiding element.

Figure 3:
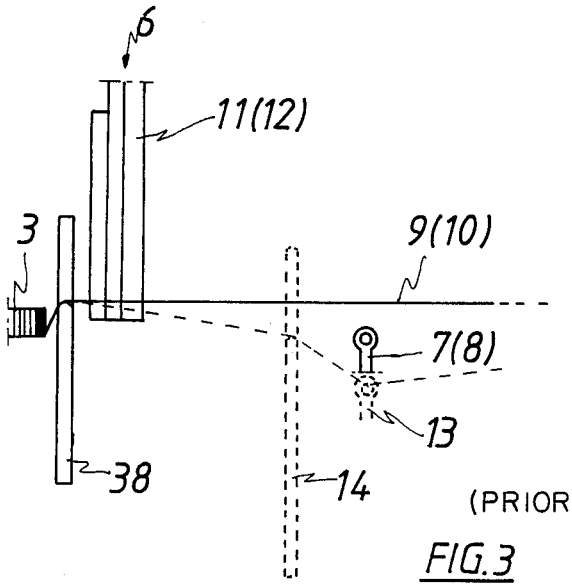
(PRIOR ART) FIG.3

FIG. 3 is a diagrammatic plan view of the end of the reed at the height of a weft scissor.

The same reference numbers relate to the same elements in the various figures.

In FIG. 1 the lay (1), is pivotely mounted in the frame of the weaving machine, via a pivotable shaft (2) and on which the reed (3) is mounted, the highest and the lowest insertion rapiers (4 and 5 respectively) and the weft-cutting device (6) are shown. The cutting device (6) consists of two weft scissors (11 and 12) mounted above each other and which are mounted on the lay via a support (29) so that they can be tilted.

The weft guiding elements (7 and 8) consists of a weft needle (39 and 40) for each of the weft threads (9 and 10) which run through the eye (41 and 42) of element (7 and 8).

Figure 2B:
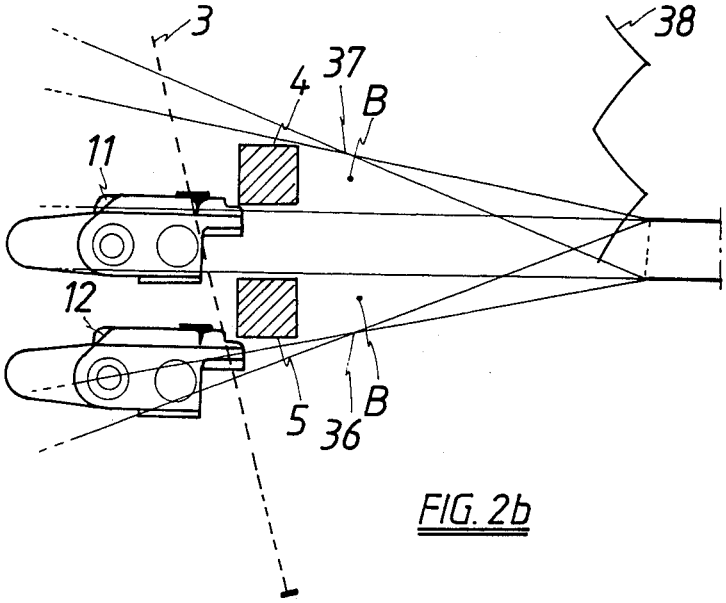
Figure 2C:
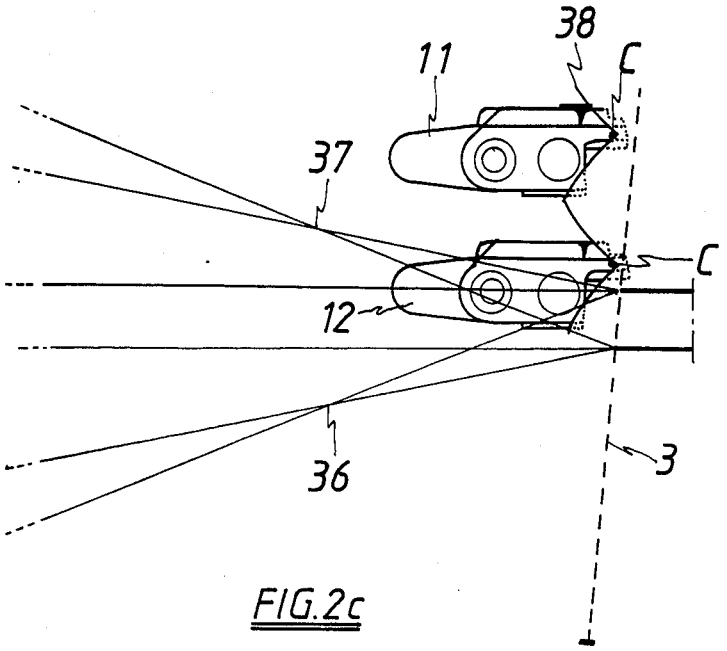

The three movement positions of the process according to the invention are the carry position, FIG. 2*a*, the insertion position, FIG. 2*b* and the beat-up position, FIG. 2*c*, shown for each weft thread FIG. 1 shows the weft guiding elements (7 and 8) in the carry position.

Referring now to FIG. 2*a*, the reed (3) is in the rearmost position. The weft guiding element (7 and 8) starts in the carry position (A). In the carry position (A), the cut-off end of each weft thread (9 and 10) is firmly clamped by the clamping device of the weft scissors (11 and 12) of the weft cutting device (6). The weft thread in this position crosses in front of the path of the insertion rapiers (4 and 5) so that the insertion rapiers are able to engage and carry the cut-off ends of the weft threads (9 and 10) as to draw the ends out of the clamping devices and carry the weft threads into the shed. The weft cutting device (6) is mounted on the lay so that it can tilt, at the moment that the insertion rapiers (4 and 5) carry the weft threads.

Immediately after the weft thread is carried by the insertion rapiers (4 and 5), the weft guiding elements (7 and 8) move downward towards the lay (1) and forward towards the weft cutting device (6) into the insertion position (B in FIGS. 2*a* and *b*). This positions the weft threads within the triangle of the shed bordered by the lower- and upper-laying warp threads (36 and 37), while the insertion rapiers (4 and 5) and the receiver rapiers (not shown) pull the weft threads through the shed (FIG. 2*b*). Due to this insertion position of the weft guiding elements which are situated in front of the path of the insertion rapiers (4 and 5), the weft thread does not touch the warp threads (36, 37 and 43-46) when it is pulled through, not even those on the edge of the fabric. The reed (3) remains in its rearmost position.

The weft thread is moved during the beat-up movement of the reed so that it comes to lie virtually parallel to the reed and in a virtually straight line. burning the beat-up movement of the reed, the weft guiding' elements move simultaneously forward with the lay and away from the weft cutting device (6) until they reach their third position, the beat-up position (C in FIGS. 2*a* and *c*). As the weft guiding elements move into the beat-up position, the weft thread moves into the weft scissors (11) of the cutting device (6) which has tilted in relation to the lay (1) during the beat-up movement of the reed. The weft cutting device (6) cuts this weft thread free and the clamping device of the weft scissors holds the cut-end of the following weft thread. During the return movement of the lay, the weft guiding elements move simultaneously backward with the lay and forward towards the weft cutting device into the carry position again.

FIG. 3 illustrates some advantages of the movement of the weft guiding device from the insertion position to the beat-up position as opposed to a firmly mounted weft guiding element used in the prior art. In the case of a firmly mounted weft-guiding element (13, broken line) an additional spreading fork (14, broken line) is necessary in order to bring the weft thread, in cooperation with the guide plate (38), and the weft scissors (11). This spreading fork (14) becomes superfluous during application of the process according to the present invention. An additional advantage is that the weft thread can follow a straight line sooner using the method according to the present invention, whereas with a firmly fixed weft guiding element, the weft thread makes a number of angles so that a weft recovery device is necessary.

The three positions of the weft guiding element in relation to the reed (3) are shown in FIG. 2*a*. In the first position, i.e. the carry position (A), the weft guiding element is found in a similar position of that of a prior art firmly mounted weft guiding element. In this position the weft thread whose cut-off end is firmly clamped by the clamping device of the weft scissors crosses in front of the path of the insertion rapier. Immediately after the weft thread is carried by the insertion rapiers, the weft guiding element moves downward towards the lay (1) and forward towards the weft cutting device (6) into the second position, i.e. the insertion position (B). The weft thread is now situated in the triangle of the shed bordered by lower- and upper-laying warp threads. During the beat-up movement of the reed (3), the weft guiding element moves simultaneously forward with the lay and away from the weft cutting device (6) into its third position, i.e. the beat-up position (C). Due to this movement of the weft guiding element the weft thread is held in a virtually straight line, virtually parallel to the reed. Also, as the weft guiding element moves to the beat-up position (C), the weft thread moves into the weft scissors (11 and 12) of the weft cutting device (6) which cuts this weft thread free and the clamping device of the weft scissors holds the end of the following weft thread at the moment the reed is at its beat-up position. During the return movement of the lay, the weft guiding elements moves simultaneously backward with the lay and moves forward towards the weft cutting device so that the carry position is achieved again. Thus the weft thread moves in relation to the lay along a curve sloping downwards and towards the front of the weaving loom.

It is clear that a large number of devices can be imagined which can give the weft guiding element the desired movement. In a preferred embodiment of the apparatus according to the invention, the weft guiding element is movably fixed on the lay of the weaving loom.

This preferred embodiment consists of a support (15), FIG. 1, which has a pivotable connection at the three apices of a triangle. A first pivotable connection via a bolt (17) with a bearing (16) firmly mounted on the lay (1) in such a way that the support (15) is fixed on the lay (1) so that it can be tilted.

A second pivotable connection, which is situated above the first, with a holder (18) via a bolt (19). And a third rotatable connection, with a rod (20) via a bolt (21).

The holder (18) preferably has an L-shape, the longest arm (22) of which has two pivotable connections. A first pivotable connection, which is approximately situated in the middle of the longest arm (22), with the support (15) via a bolt (19) and a second pivotable connection, which is approximately situated at the end of that longest arm (22), with a short rod (23) via a bolt (24). The other end of the rod (23) is likewise pivotable with the bearing (16) joined via a bolt (25).

The shortest arm (26) of the holder (18) carries the two weft needles (7 and 8) situated above each other.

The movement of the support (15) in relation to the lay (1) is achieved via the rod (20) from a cam disc (27) with a cam follower (28). The cam disc (27) can be mounted so that it can rotate about the pivotable shaft (2) of the lay (1), or can be mounted on any other axle (30) of the weaving loom as shown in FIG. 1 The cam disc (27) is driven by known, not shown, means from the drive of the weaving loom. The cam follower (28) lies at one end of a lever (31), the middle point (32) of which is joined rotatably to a section of the frame (33) and from which the other end is joined rotatably to the lowest end of the rod (20) via a rod (34). This rod (34) is, for example, connected to the lever (31) by a clamp connection (35) so that the apparatus according to the invention can be adjusted to the fabric width by altering the width direction of the bearing (16) on the lay (1).

The weft guiding elements (7 and 8) thus undergo a combined movement: they undergo the movement of the lay (1), on the one hand, and they undergo a relative movement in relation to the lay (1) towards or away from the weft cutting devices (6) on the other hand. The position of the weft guiding elements shown in FIG. 1 coincides with the carry position, position A, FIG. 2*a*. The weft guiding elements move upwards with the forward movement of the lay (1) and backwards in relation to the lay (1) away from the weft cutting device (6); when the rod (20) moves upward and they can reach the beat-up position, position C, FIGS. 2*a* and *c*. The weft guiding elements move downward and forward in relation to the lay (1) towards the weft cutting device (6) when the rod (20) moves downwards and they can reach the insertion position, position B, FIGS. 2*a* and *b*.

The embodiment of the apparatus according to the invention described here can shift the eyes of the weft needles (7 and 8) along the desired curve over the three desired positions, FIG. 2*a*, and thus applies the process according to the invention to the face to face weaving rapier loom described here with a weft-cutting device which can be tilted, which has here been taken as an example because it is representative of the latest developments in the field of rapier weaving looms.

The required positions of the weft thread according to the process according to the invention will, however, be dependent on the type of weaving loom to which the invention is applied. The relative movement of the weft needles (7 and 8) in relation to the lay (1) can in any event be determined by changing the spatial distribution of the pivotable connection of the support (15), on the one hand, and the holder (18) on the other hand, and by adapting the shape of the cam disc (27), of the cam follower (28) or of the lever (31). This embodiment of the apparatus according to the invention is thereby already adaptable to a large number of types of weaving machines. It may become necessary to fix the apparatus according to the invention to the rear of the lay (1) so that the insertion position of the weft thread lies between the weft insertion means and the reed.

The advantages of the process according to the invention are numerous. Jamming of the weft threads and of the warp threads is avoided so that fewer weft or warp breaks occur and so that slubby yarns can be excellently woven. Melting of synthetic yarns is avoided so that these synthetic yarns can be woven in the warp and in the weft at higher speeds. In specific cases a weft recovery device becomes superfluous.

I claim:

1. A process for guiding weft threads in a loom, characterized in that the weft threads are shifted relative to a moving lay of the loom over three consecutive positions, which coincide with various positions of the weft thread insertion during weaving, further characterized in that weft guiding elements are located at a height of weft cutting devices of the loom and at a position where weft insertion means leave with new ends of the weft threads, wherein the guiding elements move by means of a drive of the weaving loom;

wherein the three consecutive positions are:

a carry position, in which the weft threads extend between clamping devices of cutters into eyes of guiding elements;

followed by an insertion position, in which the weft threads are drawn from the clamping devices and are inserted into sheds, while the weft guiding elements move downward toward the lay while the weft threads are being pulled through the sheds, followed by a beat-up position in which the weft threads are held in a virtually straight line, virtually parallel to a reed and are moved into weft cutting devices at the moment that the reed is in its beat-up position; and after completing this sequence of positions, the weft threads are shifted back to the carry position and the process start anew.

2. Process according to claim 1, wherein the weft insertion means consist of a pair of rapiers and the carry position is on a side of a rapier section which is opposite to a side of a rapier section where the clamping device of the weft-cutting device is situated at the moment that ends of the weft threads are carried by the insertion rapiers, and further wherein the insertion position is next to a path of the insertion rapiers and the front surface.

3. Process according to claim 2, characterized in that the insertion position B is in front of the path of the insertion rapiers.

4. Process according to claim 1, characterized in that the movement of the weft threads at the height of the weft cutting devices at the positions where the weft insertion means leave with new ends of the weft threads, is the result of the movement of the lay and of a relative movement of the weft threads relative to the lay towards the weft cutting device.

5. An apparatus for guiding weft threads in looms, comprising:

weft guiding elements having eyes attached thereto and movable over three consecutive positions which coincide with various phases of the weft insertion during weaving;

weft cutting devices, having scissors and clamping devices;

weft insertion means for carrying the weft threads into a shed;

wherein the weft guiding elements are located at a height of the weft cutting devices of the loom and at a position where the weft insertion means leave with new ends of the weft threads, wherein the weft guiding elements move by means of a drive of the weaving loom;

wherein further the three consecutive position are:

a carry position, in which ends of the weft threads originating from bobbins are inserted through the eyes of the weft guiding devices and are firmly clamped by the clamping device of the weft scissors of the weft cutting devices, so that the weft threads cross a path of the weft insertion means;

followed by an insertion position, in which the ends of the weft threads are drawn from the clamping devices by the inserting means and are inserted into sheds while the guiding elements move downward toward the lay while the weft threads are pulled through the shed;

followed by a beat-up position, in which the weft threads are held in a virtually straight line, virtually parallel to a reed and are moved into the weft cutting devices;

and after the complete sequence of these three positions, the weft guiding elements return to the carry position, wherein this sequence starts anew.

6. Apparatus according to claim 5, wherein the weft insertion means consists of a pair of insertion rapiers and the carry position is on a side of a rapier section opposite to a side of the rapier section where a clamping device of the weft-cutting device is found at the moment that ends of the weft threads are carried by the insertion rapiers, and wherein further the insertion position, is next to a path of the insertion rapiers.

7. Apparatus according to claim 6 characterized in that the insertion position lies in front of the path of the insertion rapier.

8. Apparatus according to claim 5, characterized in that the weft guiding elements are mounted via a pivotable connection on the lay of the loom.

9. Apparatus according to claim 8, characterized in that the weft guiding elements are shifted relative to the lay by means of a cam disc, mounted rotatably in the loom, which is driven from a drive of the loom and whose periphery is followed by a cam follower whose movement is transmitted to the weft guiding elements via a transmission of one or more levers and/or rods.

10. Apparatus according to claim 11, characterized in that the transmission comprises a connection which can be fully secured and which is adjustable in width.

11. Apparatus according to claim 8, characterized in that the movable connection between the weft guiding elements and the lay consists of two levers, the first of which is a bearing which is connected pivotably to the lay, one of its ends is pivotably connected to the drive of the weft guiding elements and its other end is pivotably connected to the second lever, and the second of which is a holder which carries the weft guiding elements on one of its ends and whose other end is pivotably connected to a rod whose other end is pivotably connected to the lay.

* * * * *